US007260904B1

(12) United States Patent
Boisseau

(10) Patent No.: US 7,260,904 B1
(45) Date of Patent: Aug. 28, 2007

(54) WALL CALENDAR SYSTEM

(76) Inventor: Teresa Boisseau, 246 Wanda Rd., Pasadena, MD (US) 21122

( * ) Notice: Subject to any disclaimer, the term of this patent is extended or adjusted under 35 U.S.C. 154(b) by 263 days.

(21) Appl. No.: 11/114,784

(22) Filed: Apr. 25, 2005

(51) Int. Cl.
*G09D 3/00* (2006.01)

(52) U.S. Cl. ..... 40/107; 40/119; 40/122; D19/52

(58) Field of Classification Search ..... 40/107, 40/605, 119, 122; D19/52; 248/447.1
See application file for complete search history.

(56) References Cited

U.S. PATENT DOCUMENTS 5,339,546 A 8/1994 Rahwan
D371,806 S * 7/1996 Boone et al. ..... D19/52
5,658,635 A * 8/1997 Davis et al. ..... 428/81
D390,263 S * 2/1998 Jack ..... D19/52
5,987,825 A * 11/1999 Rosen ..... 52/36.1
D417,701 S * 12/1999 Jack ..... D19/52
6,289,615 B1 * 9/2001 Kytlica ..... 40/119
6,657,924 B2 12/2003 McCravy
6,690,912 B1 * 2/2004 Vaughn ..... 434/308
D532,455 S * 11/2006 Beardslee ..... D19/52
2004/0148824 A1 * 8/2004 Nein et al. ..... 40/119
2005/0268502 A1 * 12/2005 Blakeney ..... 40/122

* cited by examiner

*Primary Examiner*—Gary C. Hoge

(57) ABSTRACT

A wall calendar system. The wall calendar system includes several separate sections, including a marker board, a cork board, a paper calendar that is pivotally mounted to the wall calendar system, and a file pouch located on the back of each month on the paper calendar so that the various important papers and business cards may be stored until needed.

7 Claims, 2 Drawing Sheets

WALL CALENDAR SYSTEM

I. BACKGROUND OF THE INVENTION

The present invention concerns that of a new and improved wall calendar system.

II. DESCRIPTION OF THE PRIOR ART

U.S. Pat. No. 6,657,924, issued to McCravy, discloses a wall-mounted combination calendar and organizer with each time period having a corresponding container.

U.S. Pat. No. 5,987,825, issued to Rosen, discloses a modular message center that is mounted to a wall and comprised of a cork board, dry erase board, and calendar sections.

U.S. Pat. No. 5,339,546, issued to Rahwan, discloses a combination calendar and organizer comprised of a plurality of color coded pockets.

III. SUMMARY OF THE INVENTION

The present invention concerns that of a new and improved wall calendar system. The wall calendar system includes several separate sections, including a marker board, a cork board, a paper calendar that is pivotally mounted to the wall calendar system, and a file pouch located on the back of each month on the paper calendar so that the various important papers and business cards may be stored until needed.

There has thus been outlined, rather broadly, the more important features of a wall calendar system that the detailed description thereof that follows may be better understood and in order that the present contribution to the art may be better appreciated. There are, of course, additional features of the wall calendar system that will be described hereinafter and which will form the subject matter of the claims appended hereto.

In this respect, before explaining at least one embodiment of the wall calendar system in detail, it is to be understood that the wall calendar system is not limited in its application to the details of construction and to the arrangements of the components set forth in the following description or illustrated in the drawings. The wall calendar system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present wall calendar system. It is important, therefore, that the claims be regarded as including such equivalent constructions insofar as they do not depart from the spirit and scope of the present invention.

It is therefore an object of the present invention to provide a wall calendar system which has all of the advantages of the prior art and none of the disadvantages.

It is another object of the present invention to provide a wall calendar system which may be easily and efficiently manufactured and marketed.

It is another object of the present invention to provide a wall calendar system which is of durable and reliable construction.

It is yet another object of the present invention to provide a wall calendar system which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
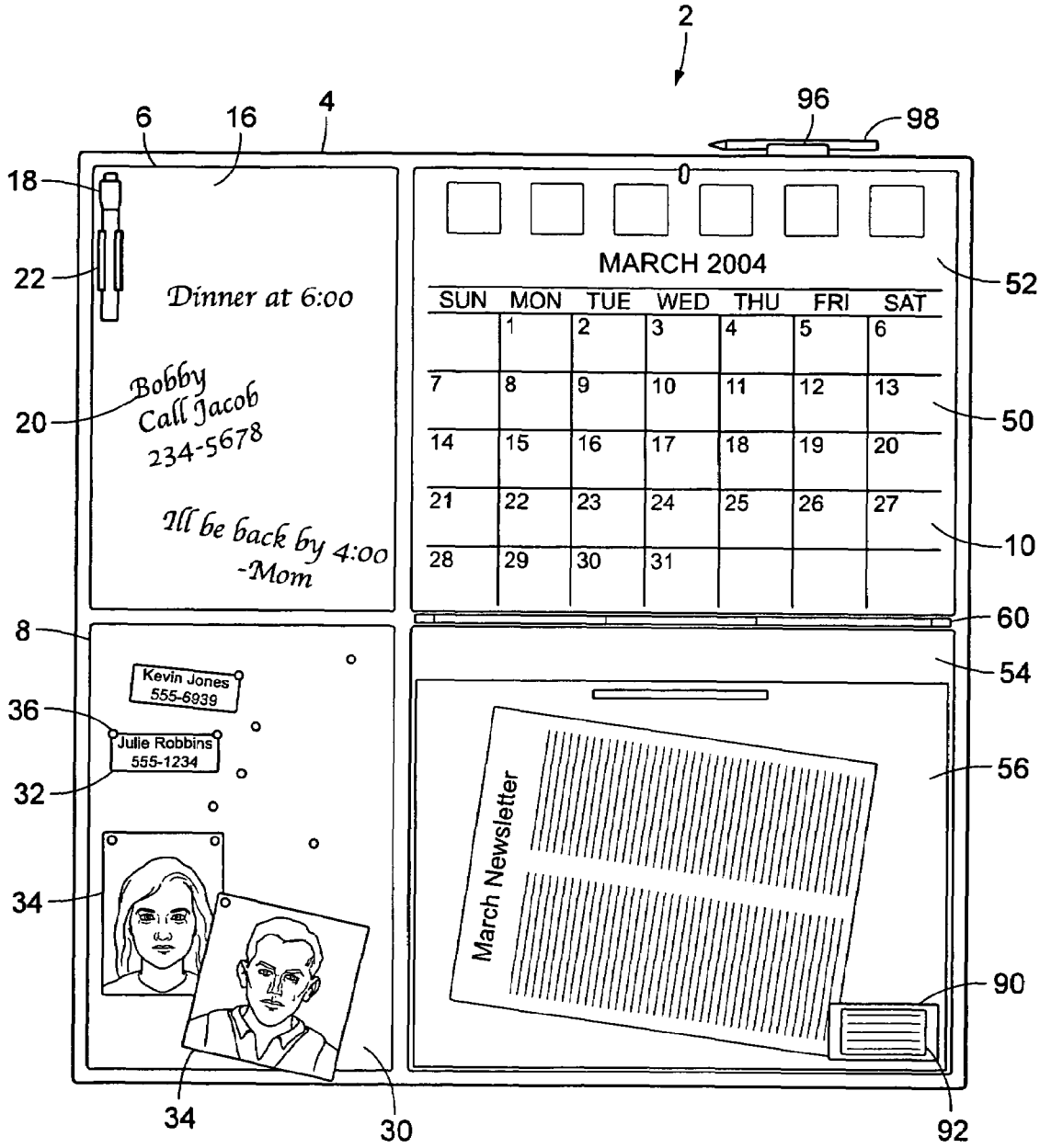
FIG. 1 shows a front view of the wall calendar system.
Figure 2:
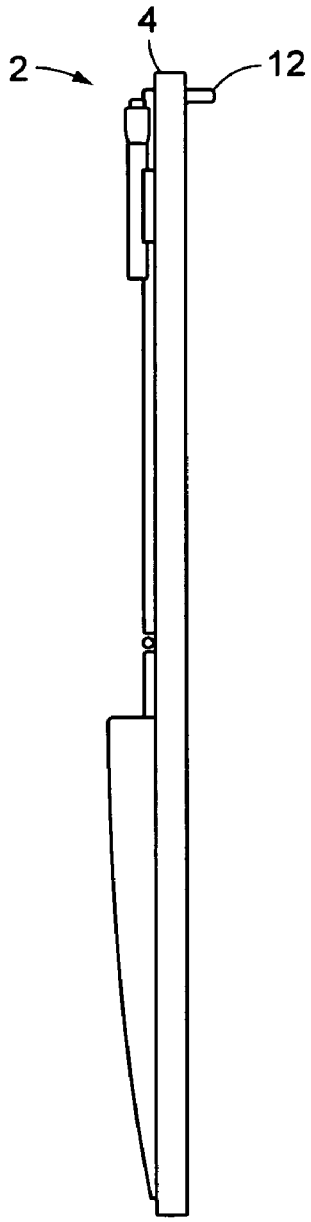
FIG. 2 shows a side view of the wall calendar system.

FIG. 1 shows a front view of the wall calendar system 2, while FIG. 2 shows a side view of the wall calendar system 2. Wall calendar system comprises a backing 4, a marker board component 6, a cork board component 8, and a paper calendar component 10.

Backing 4 has two surfaces, a front surface and a rear surface. The rear surface of the backing 4 preferably has an eye hook 12 or other device that will allow the wall calendar system 2 to be properly hung onto a wall surface. Backing 4 itself is preferably fabricated from cardboard, cardstock, or other material that is both pretty firm and also provides a small amount of flexibility to the backing 4.

Attached to the front surface of the backing 4 is a marker board component 6. While the marker board component 6 is shown in the upper left portion of the front surface of the backing 4, in reality, the marker board component 6 could be placed in other areas as well. However, the preferred area of the marker board component 6 is in the upper left corner of the front surface of the backing 4.

Marker board component 6 offers a marker board 16 on which an erasable marker 18 can be used to write messages 20. These message serve to notify various family members or individuals of various "going-ons" or important events. Typically, the messages 20 can be cleaned by using a dry or wet handkerchief or towel. The marker board 16 has a small area to allow a marker 18 to be mounted, preferably by a clasp 22.

Attached to the front surface of the backing 4 is a cork board component 8. While the cork board component 8 is shown in the lower left portion of the front surface of the backing 4, in reality, the cork board component 8 could be placed in other areas as well. However, the preferred area of the cork board component 8 is in the lower left corner of the front surface of the backing 4.

Cork board component 8 offers a cork board 30 on which various pieces of paper 32 or photographs 34 can be placed. Typically, these papers 32 or photos 34 are kept in place using tacks 36. These messages serve to notify various family members or individuals of various "going-ons" or important events, and also can be used to store messages or photos for medium or long term storage.

Paper calendar component 10 is attached to the front surface of the backing 4 and occupies at least half the surface area of the front surface of the backing 4. While the paper calendar component 10 is shown on what could be termed the "right half" of the front surface of the backing 4, in reality, the paper calendar component 10 could be placed in other areas as well. However, the preferred area of the paper calendar component 10 is in the "right half" of the front surface of the backing 4, as viewed from the front of the backing 4.

Paper calendar component 10 comprises a plurality of individual sheets 50, which each sheet having two surfaces, a front side 52 and a back side 54. The front side 52 of each sheet 50 of the paper calendar component 10 has a particular calendar month printed on it, while the back side 54 of each individual sheet 50 has at least one tight file pouch 56 for storing materials as needed. The individual sheets 50 are all hingeably attached to one another via a coil or spring 60.

Figure 3:
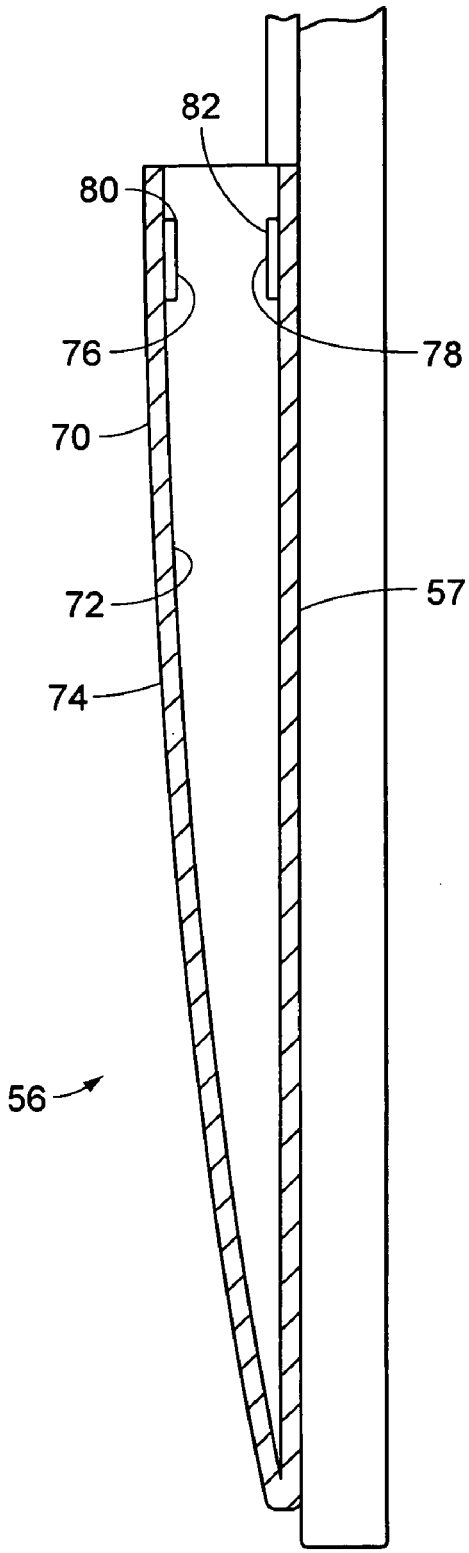
FIG. 3 shows a cross-section of the tight file pouch and its associated cover.

FIG. 3 shows a cross-section of the tight file pouch 56, which includes a file pouch backing 57 and its associated cover 70. The cover 70 has two surfaces comprising an inner surface 72 and an outer surface 74. Each tight file pouch 56 has two patches comprising a first patch 76 and a second patch 78, with the first patch 76 being located on the inner surface of the cover 70 and the second patch 78 being attached to the file pouch backing 57 of the tight file pouch 56. The first patch 76 has a first plurality of attachment objects 80, while the second patch 78 has a second plurality of attachment objects 82 that are associated with it. Between the two pluralities of attachment objects, one of the pluralities is a plurality of hooks and the other plurality is a plurality of loops. When these two patches are placed into contact with one another, they act as a "hook and loop" attachment system that will allow each tight file pouch 56 to remain closed, but also permit each one to opened as needed.

The outer surface 74 of cover 70 has a business card pocket 90 on it that allows a business card 92 to be inserted into this pocket 90. Furthermore, the backing 4 of the wall calendar system 2 also has a top-mounted pen holder 96 that will allow a pen 98 or pencil 100 to be easily mounted.

What I claim as my invention is:

1. A wall calendar system comprising:

(a) A backing having two surfaces, a front surface and a rear surface, (b) means for attaching the rear surface of the backing to a wall surface, (c) a marker board component attached to the front surface of the backing, (d) a cork board component attached to the front surface of the backing, (e) a paper calendar component attached to the front surface of the backing, the paper calendar component further comprising a plurality of individual sheets, each of the sheets having two surfaces, a front surface and a rear surface, the paper calendar component further comprising means for mounting the plurality of sheets, wherein the front surface of each sheet of the plurality of sheets has a particular calendar month printed on it, further wherein the rear surface of each sheet has a file pouch attached to it, (f) means for opening and closing the file pouch located on the rear surface of each sheet.

2. A wall calendar system according to claim 1 wherein each file pouch further comprises:

(a) a file pouch backing, and (b) a file pouch cover having two surfaces, an inner surface and an outer surface.

3. A wall calendar system according to claim 2 wherein the means for opening and closing the file pouch located on the rear surface of each sheet further comprises:

(a) a first patch attached to the inner surface of the file pouch cover, (b) a second patch attached to the file pouch backing, (c) a first plurality of attachment objects attached to the first patch, (d) a second plurality of attachment objects attached to the second patch, (e) wherein one of the plurality of attachment objects is a plurality of hooks and the other plurality of attachment objects is a plurality of loops, (f) further wherein an individual can place the first patch against the second patch to removably keep a file pouch closed, and alternatively can pull the two patches apart to open the file pouch.

4. A wall calendar system according to claim 3 wherein the marker board component is located in the upper left of the front surface of the backing.

5. A wall calendar system according to claim 4 wherein the cork board component is located in the lower left of the front surface of the backing.

6. A wall calendar system according to claim 5 wherein the paper calendar component is located in the right half of the front surface of the backing.

7. A wall calendar system according to claim 6 wherein the backing is fabricated from a firm material with a small amount of flexibility.

* * * * *